US005737928A

United States Patent [19]

Lee et al.

[11] Patent Number: 5,737,928

[45] Date of Patent: *Apr. 14, 1998

[54] PROCESS FLUID COOLING MEANS AND APPARATUS

[75] Inventors: Ron C. Lee, Bloomsbury, N.J.; Stephen Clements, West Yorkshire, England

[73] Assignee: The BOC Group, Inc., New Providence, N.J.

[ * ] Notice: The terminal 7 months of this patent has been disclaimed.

[21] Appl. No.: 401,391

[22] Filed: Mar. 9, 1995

[51] Int. Cl.[6] ..... F25D 3/00; F25C 1/00

[52] U.S. Cl. ..... 62/59; 62/74; 62/347

[58] Field of Search ..... 62/59, 74, 52.1, 62/347, 534, 376

[56] References Cited

U.S. PATENT DOCUMENTS

| | | | |
|---|---|---|---|
| 3,959,513 | 5/1976 | Strohbach et al. | 62/74 X |
| 4,488,407 | 12/1984 | Delano | 62/74 |
| 4,754,610 | 7/1988 | Knodel et al. | 62/74 |
| 4,761,962 | 8/1988 | Andersson | 62/74 X |
| 4,838,039 | 6/1989 | Knodel | 62/534 X |
| 4,864,831 | 9/1989 | Hino | 62/534 X |
| 5,218,828 | 6/1993 | Hino | 62/59 |
| 5,307,640 | 5/1994 | Fawzy | 62/52.1 |
| 5,394,705 | 3/1995 | Torii et al. | 62/74 |
| 5,402,650 | 4/1995 | Stewart, Jr. | 62/347 X |

*Primary Examiner*—Christopher Kilner

*Attorney, Agent, or Firm*—David M. Rosenblum; Salvatore P. Pace

[57] ABSTRACT

A method of cooling a liquid process fluid in which a liquid process stream is formed from the liquid process fluid and the process fluid contained within the liquid process stream is frozen into a conveyable particulate form. The conveyable particulate form is introduced back into the liquid process fluid. The liquid process fluid can be contained within a container and pumped through a pipe connected to the container to form the liquid process stream. A freezing chamber connected to the top of the container can be provided to countercurrently directly exchange heat between rising vaporized coolant and descending liquid process fluid. The resultant conveyable particulate form can be metered by provision of a valve.

18 Claims, 1 Drawing Sheet

PROCESS FLUID COOLING MEANS AND APPARATUS

BACKGROUND OF THE INVENTION

The present invention relates to a method of cooling a liquid process fluid in which a stream of the process fluid is extracted and frozen into a conveyable particulate form and the conveyable particulate form is introduced back into the liquid process fluid. More particularly, the present invention relates to such a method and apparatus in which the process fluid is frozen by direct heat exchange with a liquid cryogen coolant.

There are industrial cooling applications that arise with respect to process fluids, namely, products and intermediate products of industrial processes or intermediate chemical reactions used in forming such products. Typical methods for cooling such process fluids while they are contained within reaction vessels include both indirect and direct means. A typical indirect method would be to provide the reaction vessel with an external jacket through which a cooling fluid can be circulated. This cooling fluid in turn is circulated through an external heat exchanger in which the coolant is cooled through indirect heat exchange with a cryogenic liquid, for instance, liquid nitrogen. A common direct method involves the addition of a refrigerant into the process fluid. This may be water ice produced from a nearby ice plant, which is unceremoniously dumped into the reaction vessel and melts to provide cooling to the process fluid. Alternatively it may be a cryogenic coolant, such as dry ice or liquid nitrogen, which vaporizes in the process fluid to provide the cooling.

Existing methods based on the above have limitations and problems. The indirect methods are complex and constrained by the materials of construction of the reaction vessel and the available heat transfer surface of the reaction vessel. The current direct methods in the case of water ice are difficult to control, limited by the temperature of the ice, and may not be preferred due to the dilution effects as the ice melts. The direct methods using vaporizing cryogenic fluids may increase the size of the reaction vessel required due to gas hold-up in the process fluid and can be rejected due to problems with foaming of the process fluid or entrainment in the gas exhaust.

As will be discussed, the present invention solves the prior art cooling problems, mentioned above, by a method and apparatus that involves the freezing of the process fluid itself and therefore, can be conducted by methodology and apparatus that are far simpler than methods and apparatus used in the prior art.

SUMMARY OF THE INVENTION

The present invention provides a method of cooling a liquid process fluid. In accordance with the method, a liquid process stream is formed from the liquid process fluid. The process fluid contained within the liquid process stream is frozen into a conveyable particulate form and the conveyable particulate form is introduced back into the liquid process fluid. This method can be conducted in a batch form in which the liquid process stream is removed from a container containing a batch of the liquid process fluid and the resultant conveyable particulate form of the process fluid is then introduced back into the container. Additionally, the present invention also has application to a flowing liquid process fluid. In such case, a liquid process stream is removed from a conduit or pipe and the liquid process stream is frozen into a particulate form. The particulate form is then introduced back into the conduit by gravity, positive pressure or perhaps a constrictive venturi-like section of a pipe to create a reduced pressure within the flow.

In another aspect, the present invention relates to an apparatus for cooling a liquid process fluid comprising a container for containing the liquid process fluid. A conduit means is provided for removing the liquid process stream from the container and a freezing means is connected to the container by the conduit means for freezing the liquid process fluid contained within said liquid process stream into a conveyable particulate form. A means is associated with a freezing means for reintroducing the conveyable particulate form back into the container and the liquid process fluid contained therewithin.

As will be discussed, the freezing of the process fluid can be accomplished by direct heat exchange with a cryogen in an apparatus of simpler design than cryogenic cooling circuits of the prior art. In practice, the direct heat exchange can be conducted countercurrently to conserve cryogen. Additionally, the frozen particulate form can be sub-cooled to well below its freezing point. This will reduce the mass flow rate of the liquid process fluid required to be removed from the container in a typical application of the present invention. The present invention is advantageous where the temperature of the process liquid is to be maintained near its freezing point because particles of ice or snow produced by the present invention allow for such temperature maintenance without the complications that might arise in prior art methods, such as indirect heat exchangers or direct cryogen injection, where bulk freezing might occur. It is to be noted that the present invention also eliminates foaming problems that might occur when cryogenic coolants such as nitrogen are introduced directly in process fluids. A yet further advantage of the present invention is that it can be conducted without dilution of the process fluid. For example, the process fluid can comprise components that react with one another in the main body of the process fluid. Since it is only a frozen particulate form of the process fluid that is being reintroduced into the main body of the process fluid, changes in pH of the process fluid can be avoided.

It should be mentioned that the term "particulate form" as used herein and in the claims means a frozen form of the process fluid having the appearance of snow or ice particles. Also, the term "cryogen" as used herein and in the claims means a liquified gas such as nitrogen, oxygen, argon, carbon dioxide.

BRIEF DESCRIPTION OF THE DRAWINGS

While the specification concludes with claims distinctly pointing out the subject matter that Applicants regard as their invention, it is believed the invention will be better understood when taken in connection with the accompanying drawings in which the sole figure is a schematic diagram of an apparatus for carrying out a method in accordance with the present invention.

DETAILED DESCRIPTION

Figure 1:
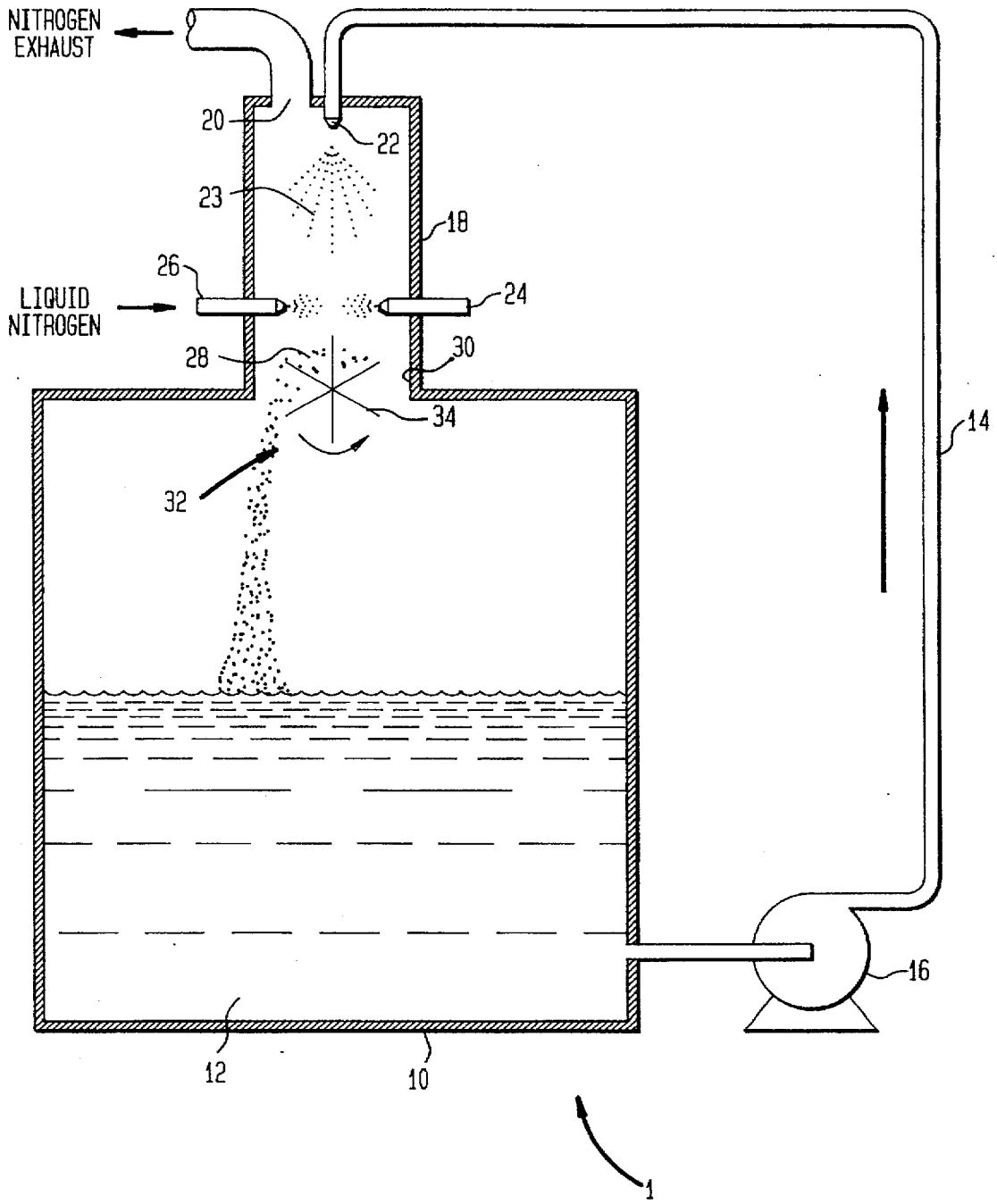

With reference to the Fig. an apparatus 1 in accordance with the present invention is illustrated. Apparatus 1 is provided with a container 10 for containing a process fluid 12. Process fluid 12 may be a fluid that is undergoing chemical reaction and is thereby liberating heat. Process fluid 12 may be introduced into and removed from container 10 by pumping process fluid 12 or its precursors with a pump and a suitable conduit positioned within container 10. A separate inlet and outlet to container 10 could be provided for this purpose.

A liquid process stream is conducted in a pipe 14 by provision of a circulation pump 16. The liquid process stream is introduced into a freezing chamber 18 having a top vent 20 by one or more nozzles 22. Nozzle 22 can be an atomizing nozzle or a spray nozzle that effects a break up and that directs the process fluid downwardly so that the process fluid descends in the freezing chamber. Two coolant nozzles 24 and 26 are located below process nozzle 22 to inject the liquid coolant into freezing chamber 18. As could be appreciated embodiments of the present invention might be constructed with one coolant nozzle or perhaps three or more coolant nozzles. The coolant utilized is one that is selected to freeze the process fluid into a conveyable particulate form. In the illustrated embodiment, the coolant is liquid nitrogen. It is to be noted that in an appropriate case, the process fluid could be frozen into the conveyable particulate form through the use of a higher temperature coolant, for instance water.

The resultant direct heat exchange causes the liquid nitrogen to vaporize within freezing chamber 18 and ascend to top vent 20. Thus, a countercurrent flow of coolant versus process fluid is set up to more efficiently utilize the cryogen. The subject invention could be effected, in a proper case, by injecting the process fluid immediately into a liquid cryogen region. Such liquid cryogen region could be formed in the freezing chamber by one or more nozzles or possibly a ring-like manifold immediately beneath nozzle 22. Furthermore, although direct heat exchange is preferred for the sake of simplicity, a freezer utilizing indirect cooling could be used to form the conveyable particulate form of the process fluid.

The conveyable particulate form 28 of the process fluid falls by action of gravity and collects in the bottom of freezing chamber. The bottom of the freezing chamber is provided with a bottom opening 30 in communication with container 12. A rotary valve 32 having vanes 34 is located within bottom opening 30 of freezing chamber 18. Vanes 34 prevent conveyable particular form 30 from falling directly into container 10 and therefore process fluid 12, as well as preventing the cold cryogenic gas from escaping freezing chamber 18. Although not illustrated, a motor or other actuating means is connected to rotary valve 32 to rotate vanes 34 and thereby introduce the conveyable particulate form back into container 10 and therefore process fluid 12. Preferably, the speed of the motor is controllable so that the rate of rotation of rotary valve 32 can in turn be controlled. Such control allows there to be a degree of control exerted over the amount of cooling provided by conveyable particulate form 28. For instance, if the speed of the motor were increased, there would be an increase in the rate of cooling provided to process fluid 12. Alternatively, rotary valve 32 could be replaced with a valve or damper which could be opened periodically or partly to allow the conveyable form 30 to enter container 10.

Although not illustrated, an embodiment of the present invention could be constructed where freezing chamber 18 is maintained at an elevated pressure. Top vent 20 would then be equipped with an appropriate back pressure regulating device, not shown. In this case, conveyable form 30 could be introduced into a pressurized receiver, such as liquid process fluid flowing through a conduit. A pressurized freezing chamber would also allow more flexibility in locating the freezing chamber because the conveyable form would not need to rely on gravity for re-introduction into the process fluid.

While the present invention has been described with reference to a preferred embodiment, as will occur to those skilled in the art, numerous changes, additions and omissions can be made without departing from the spirit and scope of the present invention.

We claim:

1. A method of cooling a liquid process fluid comprising:

forming a liquid process stream from said liquid process fluid;

freezing said process fluid contained within said liquid process stream into a conveyable particulate form; and introducing said conveyable particulate form back into said liquid process fluid.

2. The method of claim 1, wherein said liquid process fluid is frozen by direct heat exchange with coolant.

3. The method of claim 2, wherein said coolant is a cryogen.

4. The method of claim 2, wherein said coolant and liquid process stream are introduced into a freezing chamber so that said liquid process fluid freezes within said freezing chamber by direct heat exchange with said coolant.

5. The method of claim 4, wherein said coolant is introduced into said freezing chamber having a vent so that it vaporizes within said freezing chamber, rises, and is vented from said vent.

6. The method of claim 4, wherein said process fluid is sprayed into the freezing chamber.

7. The method of claim 5, wherein said coolant is sprayed into the freezing chamber downstream of the introduction of said process fluid into the freezing chamber and so that sprays of the coolant and process fluid contact one another.

8. The method of claim 5, wherein said process stream is introduced into said freezing chamber above said coolant so that said process stream descends in said freezing chamber, said direct heat exchange is conducted countercurrently and said frozen particulate form descends in said freezing chamber under gravitational influence.

9. The method of claim 1, wherein:

said liquid process fluid is located within a container;

said liquid process stream is removed from said container; and said conveyable particulate form is introduced back into the container.

10. The method of claim 8, wherein:

said liquid process fluid is located within a container;

said liquid process stream is removed from said container; and said conveyable particulate form is introduced back into the container.

11. The method of claim 10, wherein said coolant is a cryogen.

12. The method of claim 1, or claim 10, further comprising controlling rate of introduction of said conveyable particulate form to in turn control the cooling of said liquid process fluid.

13. The method of claim 1, or claim 10, wherein said particulate form falls under gravity into said container.

14. An apparatus for cooling a liquid process fluid comprising:

a container for containing said liquid process fluid;

conduit means for removing a liquid process stream form said container;

freezing means connected to said container by said conduit means for freezing the liquid process fluid contained within and liquid process stream into a conveyable particulate form;

means associated with said freezing means for reintroducing said conveyable particulate form back into said container and said liquid process fluid.

15. The apparatus of claim 14, wherein said freezing means has means for directly exchanging heat between said liquid process fluid and coolant.

16. The apparatus of claim 14, wherein:

said coolant comprises a liquid cryogen;

said freezing means comprises:

a freezing chamber having a vent;

at least one process fluid nozzle means located below said vent for introducing said process stream into said freezing chamber so that the process fluid contained within said process stream descends in said freezing chamber; and at least one coolant nozzle means located below said process nozzle means for introducing said cryogen into said freezing chamber so that it vaporizes, rises within said freezing chamber and is vented from said vent and thereby countercurrently exchanges heat with said process fluid of said product stream.

17. The apparatus of claim 14, wherein:

said freezing chamber is located on the top of said container and has a bottom opening in communication with said container; and said conduit has a pump for pumping said liquid process stream to said freezing chamber.

18. The apparatus of claim 14, wherein said conveyable particulate form reintroducing means comprises a rotary valve having vanes rotating within said bottom opening for reintroducing said conveyable particulate form back into said container so that said conveyable particulate form falls into said process fluid.

* * * * *